United States Patent [19]

Wiechert

[11] 4,281,864

[45] Aug. 4, 1981

[54] LOCKING DEVICE FOR A TRANSPORT CONTAINER OF AN ELECTRICALLY DRIVEN, RAIL-BOUND TRANSPORT CAR WITH A CONTACT DEVICE ACTUATABLE BY A TRANSPORT CONTAINER COVER FOR MONITORING THE LOCKING STATE

[75] Inventor: Edelbert Wiechert, Berlin, Fed. Rep. of Germany

[73] Assignee: Siemens Aktiengesellschaft, Berlin & Munich, Fed. Rep. of Germany

[21] Appl. No.: 29,393

[22] Filed: Apr. 12, 1979

[30] Foreign Application Priority Data

Apr. 17, 1978 [DE] Fed. Rep. of Germany ..... 2817151

[51] Int. Cl.[3] ..... E05C 3/12

[52] U.S. Cl. ..... 292/229

[58] Field of Search ..... 70/438; 292/1, 201, 292/229, DIG. 65, 202

[56] References Cited

U.S. PATENT DOCUMENTS

| | | | |
|---|---|---|---|
| 2,860,725 | 11/1958 | Cawl et al. | 292/DIG. 65 |
| 3,751,088 | 8/1973 | Schlage et al. | 292/201 |
| 3,968,984 | 7/1976 | Guth | 292/229 |

*Primary Examiner*—Richard E. Moore

*Attorney, Agent, or Firm*—Hill, Van Santen, Steadman, Chiara & Simpson

[57] ABSTRACT

In the closed state, a cover of the transport container strikes against an actuation element and displaces this element in the direction toward a contact device. The actuation stroke of the actuation element is only sufficiently large when a counter bearing of the actuation element is preformed in the direction toward the contact device when a catch which engages in the cover is brought into its final position. The inventive locking device is employed for transport containers which are placed upon an electrically driven traveling device running on rails, wherein the rail lines are laid out in such manner that the traveling device can be driven horizontally and vertically.

12 Claims, 10 Drawing Figures

LOCKING DEVICE FOR A TRANSPORT CONTAINER OF AN ELECTRICALLY DRIVEN, RAIL-BOUND TRANSPORT CAR WITH A CONTACT DEVICE ACTUATABLE BY A TRANSPORT CONTAINER COVER FOR MONITORING THE LOCKING STATE

BACKGROUND OF THE INVENTION

The invention relates to a locking device for a transport container of an electrically driven, rail-bound transport car with a cover which can be locked by means of a catch, and a contact device secured on the transport container in the area of the catch and actuatable by the cover for monitoring the locking state.

The monitoring of the locking state of the transport container ensues for reasons of operational security. Insofar as the cover is not securely locked, parts of the transport goods or the entire transport goods can fall out of the transport container in inclined, particularly vertical rail sections as well as in such rail sections in which the transport car is inverted. The contact device influences a drive control of the rail-bound transport car in such manner that transport cars which are not faultlessly locked cannot depart from the loading location or, respectively, upon occurrence of a corresponding disruption during the trip, are arrested at this location.

In a transport container known from the German Utility Model No. 76 12 348, the cover is bent in its seating area into an edge surface onto which the catch coupled to the transport container can be pushed; thus, the cover is secured against inadvertent opening.

If the catch is contacted by the operator only on the outer edge of the cover margin, then, although the cover is directly pressed against the front edge of the transport container and, thus, the contact device is actuated, security for a permanent locking of the cover is not guaranteed since, given a light shock or, respectively, loading of the cover by the transport goods being transported—particularly in vertical travel or in stretches in which the traveling device of the rail-bound transport car and thus the transport goods lie above the cover—the catch can slide off from the seating edge on the cover and thus the locking can be released.

SUMMARY OF THE INVENTION

The object underlying the invention consists in preventing the actuation of the contact device when the catch is not completely pushed onto the seating edge of the cover and thus preventing the departure of the electrically driven rail-bound transport car. This object is achieved in that an actuation element which can be deflected by means of the cover against the force of a spring is allocated to the contact device, which actuation element is supported on a bearing whose position is dependent upon the position of the catch in such manner that the deflection of the actuation element in the marginal position of the catch on the cover is too low for the actuation of the contact device but which is sufficient for actuation of the contact device when the catch is placed in its final position.

The specific advantage of the invention can be seen in the result that the actuation of the contact device monitoring the locking state is not only made dependent upon a specific position of the cover but rather also upon a specific position of the catch.

This is rendered possible particularly in that the displacement of the actuation element upon placing the cover on the transport container is dependent upon the position of the bearing and in that this position of the bearing in turn is made dependent upon the position of the catch.

In one exemplary constructional embodiment of the inventive locking device, the actuation element is designed as a bar whose one end rests against the bearing and whose other end rests on the spring; the contact device is arranged below the bar and intermediate the ends of the bar, between the bearing and the spring; and the cover contour influencing the bar in the locked state of the cover is situated above the bar and acts on the end of the bar remote from the bearing.

Thereby, the bar is placed obliquely in such manner that the cover when placed on rotates the bar into an approximately horizontal position; however, the bar can also be directed horizontally and have a projection pointing upward on which projection the cover strikes during the locking movement. Thereby, the height of the projection is expediently dimensioned in relation to the cover-produced actuation stroke of the actuation element so that the cover alone does not yet actuate the contact device even upon attainment of the fully closed position.

The spring for the actuation element or if necessary, respectively, a resetting spring for the bearing can be designed for example as leaf springs or as coil springs which are clamped or, respectively, seated in a common carrier.

Preferred embodiments of the invention, however, provide that the spring and the actuation element or, respectively, the resetting spring and the actuation element are united to form an actuation spring.

The dependence of the deformation of the actuation spring occasioned by means of the influence of the cover upon the position of the catch and upon the position of the bearing can thereby be achieved, for example, in that upon the approach of the catch to its final position a cam which determines the free flexional length of the actuation spring is displaced in such manner that the free flexional length increases and, thus, the actuation stroke becomes larger.

A preferred embodiment of the invention, however, provides that the actuation spring exhibits a U-shaped contour inclined with respect to the horizontal whose upper arm end is clamped and whose lower arm end rests on the bearing; and that a switching cam of the contact device is situated in the middle area of the lower arm beneath said arm.

According to a further development of this embodiment, the actuation spring is pre-loaded in such manner that it presses the bearing toward a guidance contour with a predetermined bias force by means of a surface of the lower arm which faces the upper arm at least in the transition area to the upper arm. Thereby, the pre-loading is dimensioned in such manner that a bending of the lower arm by means of the bearing remains without influence on the position of the upper arm; thus, the lower arm is bent up with respect to the upper arm.

The dependence of the actuation of the contact device upon the position of the catch is preferably achieved in the framework of the inventive locking device in such manner that the bearing is formed by means of the end area of a lever arm of a two-armed lever whose second lever arm can be actuated by the catch.

Thereby, the two-armed lever is designed and seated in such manner that it displaces the point at which for example the lower arm of the U-shaped actuation spring touches in the direction toward the contact device, so that the subsequent bending of the actuation spring leads to a greater deflection of the actuation spring in relationship to the resting state of said spring and thus leads to an effective actuation of the contact device.

Insofar as the two-armed lever is seated in a breach of a support mounted on the transport container and accepting the contact device and the actuation spring, a particularly simple and disruption-insensitive embodiment ensues for both the constructional design of the two-armed lever as well as, particularly, for its seating in that the bearing is designed as a flat spring strip which lies against an edge of the breach with a buckling location which separates the two lever arms describing an obtuse angle from one another.

In the following, the invention is explained on the basis of a sample embodiment illustrated in the accompanying drawings; and other objects, features and advantages will be apparent from this detailed disclosure and from the appended claims.

BRIEF DESCRIPTION OF THE DRAWINGS

The Figures of drawings show the position of the actuation spring and of the bearing respectively in front and side elevational views for different characteristic operation phases.

DETAILED DESCRIPTION

Figure 1A:
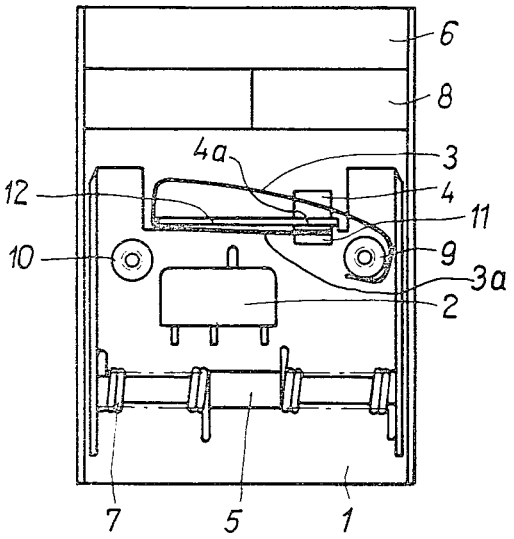
In FIGS. 1A and 1B, collectively termed FIG. 1, the cover has not yet been placed on the transport container and the catch is withdrawn out of its engaging position.

FIGS. 1 through 4 respectively show a carrier or support means 1 on which a contact device 2, an actuation spring 3 and a bearing 4 are arranged. Further, the carrier 1 has a bearing axle 5 around which a catch 6 can be manually rotated against the force of a spring 7. The catch 6 bears leading rollers 8 which can be pushed onto the cover edge—not illustrated—of a transport container. The carrier 1 can be screwed onto a transport container with the assistance of two threaded bushings 9 and 10. In common with the adjacent side wall of the carrier 1, the threaded bushing 9 represents the location of the clamping of the actuation spring 3.

Figure 1B:
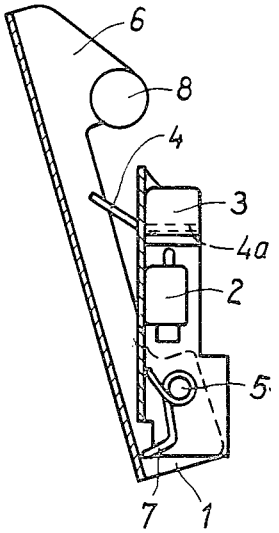

In the operational phase illustrated in FIG. 1, in which a cover has not been placed on the transport container and the catch 6 is not inserted into its locking position, the actuation spring 3 is completely uninfluenced and lies above the contact device 2. The bearing 4 is designed as a flat, bent bend; this band is seated in a breach 11 in a wall of the carrier 1 leading in the direction toward the catch 6. The end 4*a* of the bearing 4 lying against a lower arm 3*a* of the actuation spring 3 is pressed upwardly against a tab 12 bent out from the carrier 1, by means of the flexion of the actuation spring 3.

Figure 2A:
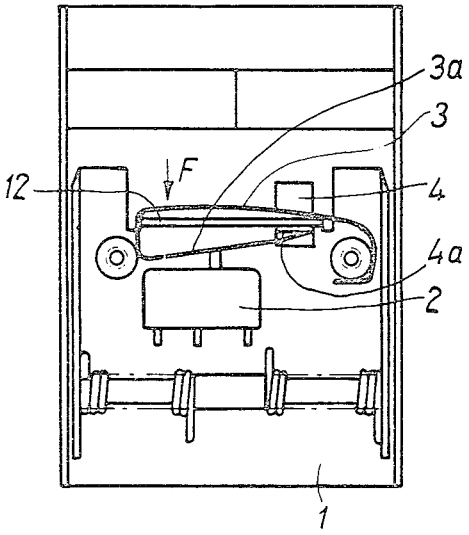
In FIGS. 2A and 2B, collectively termed FIG. 2, the cover has been placed on the transport container, but the catch is still situated in its disengaged position.
Figure 2B:
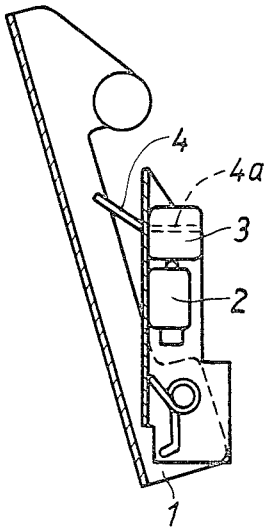

FIG. 2 shows that when the cover (indicated at C in FIG. 4) is placed on the transport container, the flexional curve of the actuation spring 3 proceeds, because of the pressure of the bearing 4 against the tab 12 of the carrier 1, in such manner that no actuation of the contact device 2 can occur.

Figure 3A:
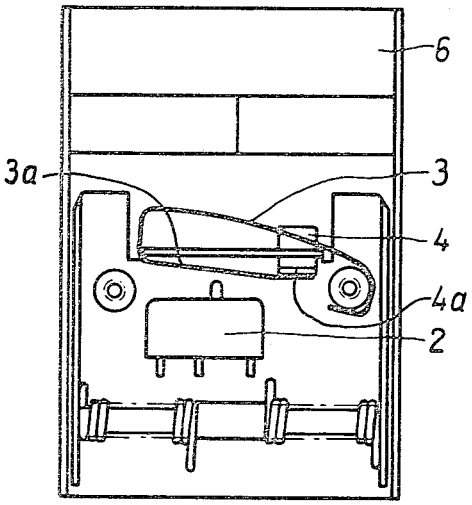
FIGS. 3A and 3B (collectively termed FIG. 3) show the position of the contact spring when the catch is placed in its engaging position but with the cover not yet in place on the container.
Figure 3B:
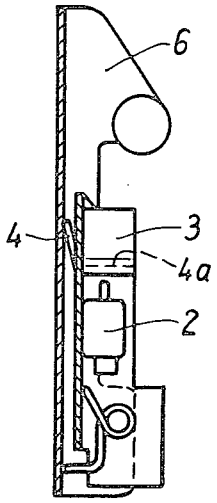
Figure 4A:
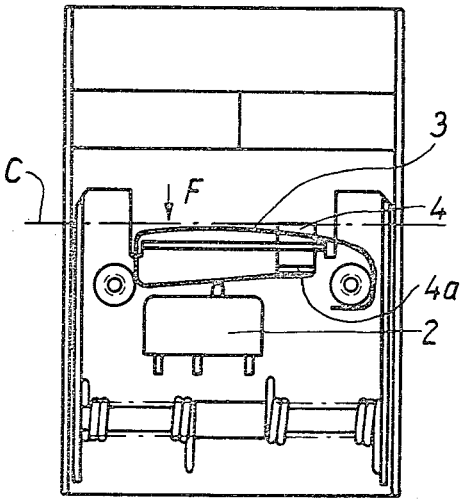
FIGS. 4A and 4B (collectively FIG. 4) illustrate the faultless locking of the transport container when the cover is placed on and the catch is in its final position.
Figure 4B:
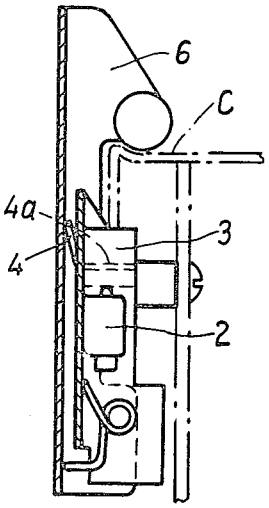

FIG. 3 shows that the snapping-in of the catch 6 into its resting position by itself indeed displaced the counter bearing end 4*a* lying against the lower leg 3*a* of the actuation spring 3 toward the bottom of breach 11, but that this displacement is not sufficient in order to actuate the contact device 2.

A sufficient flectional stroke of the actuation spring 3 only exists when both the cover C has been placed on the transport container—symbolized by means of the illustrated arrow of force F—and the catch 6 has been inserted in its locking position. When the force F becomes effective, the elastic line of the actuation spring 3 is changed by means of the downward displacement of the contact point of the bearing end 4*a* against the actuation spring 3 in such manner that an actuation of the contact device 2 ensues.

Figure 5A:
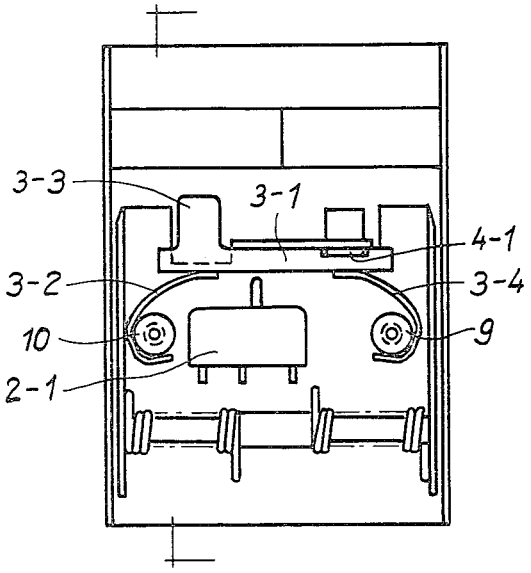
FIGS. 5A and 5B show a modification of the preferred embodiment.
Figure 5B:
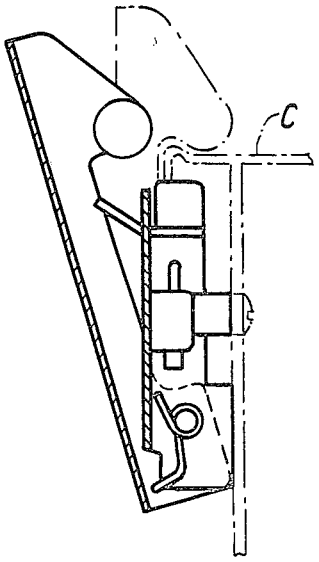

FIG. 5 illustrates one of the modifications described in the section headed Summary of the Invention. Accordingly, the description in the Summary of the Invention is specifically applied to each of the illustrated embodiments and particularly to the embodiment of FIGS. 5A and 5B for the sake of explaining modifications of the preferred embodiment shown in FIGS. 1–4. By way of example, in one embodiment according to FIGS. 5A and 5B, actuation element 3-1 is designed as a bar whose one end rests against the bearing 4-1 and whose other end rests on a spring 3-2. Contact device 2-1 is arranged below the bar 3-1 and intermediate the ends thereof between the bearing 4-1 and the spring 3-2. The cover contour C influencing the bar 3-1 in the locked state of the cover is situated above the bar and acts on the end of the bar remote from the bearing 4-1. The bar 3-1 is illustrated as having a projection 3-3 pointing upward on which projection the cover C strikes during the locking movement. Thus the height of the projection is to be dimensioned in relation to the cover-produced actuation stroke of the actuation element 3-1 so that the cover alone does not yet actuate the contact device 2-1 even upon attainment of the fully closed position of the cover as indicated in dot-dash outline in FIG. 5B. A resetting spring 3-4 for bearing 4-1 is shown as a leaf spring which is clamped on the bushing 9 while leaf spring 3-2 is clamped on the bushing 10.

The various features of each of the embodiments of the specifications and claims are hereby specifically disclosed as applicable to each of the other embodiments herein. It will be apparent that many further modifications and variations may be effected without departing from the scope of the novel concepts and teachings of the present invention.

I claim as my invention:

1. A locking device for a transport container of an electrically driven rail-bound transport car, comprising support means for operative association with a transport container which is to receive a cover in closing relation thereto, a catch carried by said support means and movable from a disengaged position to a fully engaged position, the catch is said fully engaged position being operative for securely retaining the cover in said closing relation to the transport container, a contact device secured to said support means in the vicinity of said catch for monitoring the locking state of the catch with respect to the cover and being actuatable in response to fastening of the cover in said closing relation by means of said catch, an actuation element mounted by said support means so as to be engageable with the cover as the cover is moved into said closing relation to the transport container, and being resiliently urged by a spring force toward a non-actuating condition relative to said contact device, a bearing controlling movement of the actuation element to an actuating relationship to said contact device, said bearing being movably mounted by said support means and being movable by a portion of the catch as the catch is moved toward said engaged position, toward an enabling position, said bearing when in said enabling position being disposed to enable actuation of the contact device by the actuation element, said bearing when not completely moved to said enabling position by the catch because of the catch not being fully moved to its fully engaged position, preventing actuation of the contact device even when the actuation element is deflected against the spring force by means of the cover being disposed in its closing relation to the transport container, and said actuation element being movable to actuate said contact device only when the cover is in said closing relation to the transport container and the catch has been fully moved to its fully engaged position relative to the cover.

2. A locking device according to claim 1, characterized in that the actuation element extends generally horizontally above the contact device and has an end portion underlying the bearing so as to be urged downwardly toward the contact device upon movement of the catch toward the fully engaged position, and the actuation element having an upper surface portion engageable with the cover contour as the cover is moved to closing relation, said upper portion being substantially horizontally offset from said end portion so that the actuation element is moveable to actuate the contact device therebelow only when the cover is in engagement with said upper portion of said actuation element and is in said closing relation to the transport container and the catch has been fully moved to its fully engaged position relative to the cover.

3. A locking device according to claim 2, with said actuation element comprising a generally horizontally extending bar with one end thereof providing said end portion underlying said bearing and with an opposite end portion providing said upper surface portion, and individually deflectable spring means supporting said one end of said bar and opposing deflection thereof downwardly by means of said bearing, and the other of said spring means acting at the other end of the bar and opposing downward deflection thereof as the cover is moved to said closing relation to the transport container.

4. A locking device according to claim 1, characterized in that spring means for exerting said spring force for urging said actuation element toward said nonactuating condition is an integral part of said actuation element.

5. A locking device according to claim 2, characterized in that reset spring means opposes downward movement of the bearing and is an integral part of the actuation element.

6. A locking device according to claim 2, characterized in that the actuation element comprises a U-shaped spring with an extended upper arm providing said upper surface portion and secured with said support means remote from said upper surface portion, and having an extended lower arm providing said lower end portion acting on said bearing to oppose downward movement thereof, said contact device having actuating cam means disposed in alignment with a middle region of the lower extended arm for actuation only when the upper surface portion of the upper arm is deflected downwardly by the cover in said closing relation and the catch has been fully moved to its fully engaged position to shift the lower leg of the spring downwardly by means of the bearing, the upper and lower legs of the spring being coupled together at the end of the spring remote from said bearing, and the upper leg being secured to the support means adjacent the bearing.

7. A locking device according to claim 6, characterized in that the U-shaped spring is prestressed in such manner that it presses the lower leg thereof upwardly against the bearing, and a guidance contour limiting the upward movement of the lower leg of the U-shaped spring in the nonengaged position of the catch.

8. A locking device according to claim 7, characterized in that the guidance contour is formed by a projection of the support means for the contact device and the U-shaped spring.

9. A locking device according to claim 1, characterized in that a two-armed lever is mounted for rocking movement by the support means, an end area of a first lever arm of said lever providing said bearing and the second lever arm of said lever being disposed for actuation by the catch as the catch is moved to its fully engaged position relative to the cover.

10. A locking device according to claim 9, characterized in that the first lever arm forming the bearing engages with an interior upwardly directed surface of the actuation element, the actuation element biasing said first lever arm upwardly, and the bearing provided by said first lever arm being rotated downward upon the approach of the catch to its final position.

11. A locking device according to claim 9, characterized in that the two-armed lever is seated in a breach of the support means.

12. A locking device according to claim 11, characterized in that the two-armed lever providing the bearing is designed as a flat spring strip which presses against an edge of the breach at a fulcrum location which separates the two lever arms, the two lever arms defining an obtuse angle with respect to each other.

* * * * *